US008316986B2

(12) United States Patent
Quasney et al.

(10) Patent No.: US 8,316,986 B2
(45) Date of Patent: Nov. 27, 2012

(54) SOUND ATTENUATION CANOPY

(75) Inventors: Judit A. Quasney, Silver Spring, MD (US); Franklin Koh, Potomac, MD (US); John P. Jenkins, Frederick, MD (US); Robert M. Alexander, Mount Airy, MD (US); Daniel P. O'Brien, Boonsboro, MD (US)

(73) Assignee: The United States of America, as represented by the Secretary of the Department of Health and Human Services, Washington, DC (US)

( * ) Notice: Subject to any disclaimer, the term of this patent is extended or adjusted under 35 U.S.C. 154(b) by 0 days.

(21) Appl. No.: 13/303,063

(22) Filed: Nov. 22, 2011

(65) Prior Publication Data

US 2012/0103721 A1 May 3, 2012

Related U.S. Application Data

(63) Continuation of application No. 12/764,872, filed on Apr. 21, 2010, now Pat. No. 8,069,947.

(51) Int. Cl.
*E04F 17/04* (2006.01)

(52) U.S. Cl. ..... 181/224; 181/284; 181/30

(58) Field of Classification Search ..... 181/224, 181/284, 30

See application file for complete search history.

(56) References Cited

U.S. PATENT DOCUMENTS

| | | | | |
|---|---|---|---|---|
| 1,938,801 | A | | 12/1933 | Bourne et al. |
| 1,955,479 | A | | 4/1934 | Weinberger |
| 2,974,745 | A | | 1/1954 | Kristiansen |
| 3,059,564 | A | * | 10/1962 | Curran et al. ..... 454/262 |
| 3,085,647 | A | * | 4/1963 | Jenn et al. ..... 181/224 |
| 3,378,100 | A | | 4/1968 | Welty |
| 3,989,415 | A | | 11/1976 | Van-Hee et al. |
| 4,146,112 | A | | 3/1979 | Usry |
| 4,279,325 | A | * | 7/1981 | Challis ..... 181/211 |
| 4,572,327 | A | | 2/1986 | Dean |

(Continued)

FOREIGN PATENT DOCUMENTS

JP 06-059745 8/1994

(Continued)

OTHER PUBLICATIONS

International Search Report and Written Opinion for PCT//US2011/033246 (mailed Dec. 27, 2011).

(Continued)

*Primary Examiner* — Forrest M Phillips

(74) *Attorney, Agent, or Firm* — Klarquist Sparkman, LLP

(57) ABSTRACT

A sound attenuation canopy for reducing levels of sound passing through an opening comprises a sound absorbing member. The member is comprised of a flexible sound absorbing material and has a first end, a second end and an intermediate portion extending therebetween. The first end is configured to attach to the opening's periphery at a first location, the second end is configured to attach to the periphery at a second location and the intermediate portion is configured to be spaced apart from the opening. When the first end and the second end are attached to the periphery of the opening, at least one side opening is at least partially defined by the intermediate portion and the perimeter of the opening, and a sound transmission flow path through open space between the opening and the side opening comprises at least one change of direction greater than 45 degrees.

20 Claims, 8 Drawing Sheets

U.S. PATENT DOCUMENTS

| | | | | |
|---|---|---|---|---|
| 4,660,676 | A | 4/1987 | Eustace | |
| 4,801,316 | A | 1/1989 | Schroeder | |
| 5,386,779 | A | 2/1995 | Baker | |
| 5,663,535 | A | 9/1997 | MacDonald et al. | |
| 6,104,608 | A * | 8/2000 | Casinelli et al. | 361/692 |
| 6,450,289 | B1 | 9/2002 | Field et al. | |
| 6,752,240 | B1 | 6/2004 | Schlagenhaft | |
| 6,880,813 | B2 * | 4/2005 | Yazici et al. | 261/29 |
| 6,892,851 | B2 * | 5/2005 | Lee | 181/224 |
| 6,953,104 | B2 | 10/2005 | Monson et al. | |
| 7,549,505 | B1 * | 6/2009 | Kawar | 181/210 |
| 7,644,803 | B2 * | 1/2010 | Hashizume | 181/225 |
| 7,646,603 | B2 * | 1/2010 | Bard et al. | 361/696 |
| 7,712,576 | B2 | 5/2010 | Goto et al. | |
| 2008/0190711 | A1 | 8/2008 | Patrick et al. | |
| 2008/0259616 | A1 * | 10/2008 | Morgan et al. | 362/404 |
| 2009/0133957 | A1 | 5/2009 | Owens | |

FOREIGN PATENT DOCUMENTS

| | | |
|---|---|---|
| JP | 09-217480 | 8/1997 |
| JP | 2000-111111 | 4/2000 |

OTHER PUBLICATIONS

Acoustical Surfaces, Inc., "Air Flow Silencers, Plenum Return Silencers," 1 p. (Jun. 16, 2009).

Acoustical Surfaces, Inc., "Echo Eliminator Plenum Barrier, ⅞" Acoustic Composite," 4 pp. (Mar. 4, 2002).

Acoustical Surfaces, Inc., "Echo Eliminator, 3# Density Natural Fiber Acoustic Board—Thickness 1"," 4 pp. (May 18, 1999).

Caice, "Acoustic Hoods," 2 pp. (no date).

Caice, "Design Guide—for Privacy in Cellular Offices," 2 pp. (no date).

Caice, Leaflet L360A, 2 pp. (Jan. 3, 1999).

Flexible Technologies, Inc., "Return Air Boot," 1 p. (no date).

Soundmasking, "Dynasound's DS2022 Return-Air Grill Attenuator," 1 p. (no date).

Soundproofcow, "Acoustic Foam Panel, Thickness: 1¼ in.," 2 pp. (no date).

Soundproofcow, "Quiet Barrier® Specialty Composites," 2 pp. (no date).

* cited by examiner

SOUND ATTENUATION CANOPY

CROSS REFERENCE TO RELATED APPLICATION

This application is a continuation of U.S. patent application Ser. No. 12/764,872, filed Apr. 21, 2010 now U.S. Pat. No. 8,069,947, which is incorporated herein in its entirety.

FIELD

The present application relates to sound attenuation, and in particular, to a sound attenuation canopy and methods for reducing undesired sound levels in occupied spaces.

BACKGROUND

High sound levels in work settings can have negative effects on worker concentration and productivity as noise can be a distraction. Even office spaces with offices separated by walls and doors transmit sound between them. As office buildings optimize space use, the outcomes often result in a decrease of the average amount of space allotted for each person, office, or work area. With more office workers in a given area, the noise levels in that area are increasing beyond acceptable levels.

Some gains in controlling unwanted sound transmission can be made by addressing the composition or construction of the walls and doors that separate adjacent spaces. In addition, any voids or penetrations which could transfer sound between an office and the adjoining spaces that can also be sealed or insulated. However, these more conventional approaches still do not deliver the degree of sound mitigation often desired in a work setting.

Within the space above the suspended interior ceiling, many modern office buildings often have a plenum cavity common to a number of offices and adjoining spaces. The plenum cavity is typically an unconditioned horizontal space usually encompassing the entire ceiling area of a floor. The purpose of the ceiling plenum is to house building infrastructure systems such as heating, air conditioning, ventilating, lighting, cabling, fire sprinkler, telecommunications and/or structural elements, among some of the more common elements. The ceiling plenum is considered a non-occupiable area and is enclosed at its base by the suspended ceiling system which consists of the suspended ceiling grid and the lay-in tiles of the grid. In addition, this ceiling assembly is penetrated by various items such as: light fixtures, air supply and return devices, sprinkler heads, telecommunication devices and fire egress devices. Given the nature of conventional suspended ceiling assemblies and the plenum spaces which they create, occupied work areas on a given floor are subjected to various penetrations. Each penetration is a potential area for sound transmission allowing sound to carry from one work area to another through the ceiling plenum and the various penetrations within the suspended ceiling assembly. The ceiling openings, which are typically fitted with return air grilles, are designed to allow air flow back into the plenum naturally allowing ventilation of occupied spaces via air flow. This method of air return has been conventionally applied to commercial office buildings since the beginning of the $20^{th}$ century and is recognized as a viable, cost effective method. These return air grilles also act as pathways by which sound travels from one occupied office through the ceiling plenum to another occupied office.

Prior efforts to reduce unwanted sound transmission through return air grilles have had limited success. Providing enclosed ducting for each return air grille is costly and time consuming to install, and is often not feasible due to vertical space constraints within the plenum. In addition, installers are required to enter the plenum with frequency to address maintenance of the buildings systems housed in this area. The plenum areas can be dusty and have other debris—a common condition in buildings which, when disturbed, can create unacceptable air quality conditions for workers. Conventional sound attenuators positioned over return air grilles or other lay-in ceiling penetrations have not proven to provide a cost effective reduction in unwanted sound transmission, tend to be heavy stressing the lay-in ceiling grid, are often bulky to handle and install, and are an impediment when accessing the ceiling plenum for routine maintenance throughout the lifecycle of the building.

SUMMARY

Described below are embodiments of a sound attenuation canopy that reduces levels of sound passing through an opening, such as a ceiling opening fitted with a return air grille. The sound attenuation canopy comprises a sound absorbing member formed of a flexible sound absorbing material and having a first end, a second end and an intermediate portion extending between the first end and the second end. The first end of the member is configured to attach to or be positioned adjacent a periphery of the opening at a first location. The second end of the member is configured to attach to or be positioned adjacent a periphery of the ceiling opening at a second location. The intermediate portion of the sound absorbing member is configured to be spaced apart from the opening. When the first end and the second end of the sound absorbing member are each attached to the periphery of the opening, at least one side opening is defined, at least partially, by the intermediate portion of the member and the perimeter of the opening, such that a sound transmission path in open space between the opening and the side opening comprises at least one change of direction greater than 45 degrees.

According to some embodiments, the opening is rectangular, and the sound absorbing member is shaped as a rectangle having a first pair of opposing sides that form the first end and the second end, respectively, and a second pair of opposing sides that together with the periphery of the opening define a first side opening and an opposite second side opening, respectively. In some embodiments, the rectangular opening is a square opening.

The opening may be formed in a ceiling and comprise a ceiling air grille, and the sound attenuation canopy may be designed for positioning above the opening in a plenum air space above the ceiling. It would of course be possible to position the canopy over other types of openings in other locations, e.g., the canopy could be positioned over a supply opening.

The sound attenuation canopy can be generally arch-shaped, peaked in elevation at its central point. The sound attenuation canopy may also include a frame having at least a first frame member to which the first end of the sound absorbing member is attached and a second frame member to which the second end of the sound absorbing member is attached, as well as an intermediate frame member that connects the first frame member and the second frame member.

The sound attenuation canopy may include a frame sized for the opening in the ceiling, the frame having flanges positioned to project through the opening and to which the sound absorbing member is attached. The sound attenuation canopy may include a perforated grille cover member positioned at the opening and located on either side thereof, such as within the ceiling plenum or within the room.

The sound attenuation canopy may include at least one supplemental sound absorbing member positioned to overlie a portion of the opening. The sound attenuation canopy may include a perforated grille covering the opening and a spacer member, and the supplemental sound absorbing member may be positioned on the spacer member, thereby defining a gap between the perforated grille and the supplemental sound absorbing member. Alternatively, the supplemental sound absorbing member may be positioned in contact with the perforated grille to block some of the airflow area.

The sound attenuation canopy may comprise a support member shaped to support the sound absorbing member. The support member may be formed of a relatively rigid material to fit over an outer surface of the sound absorbing material. In a specific implementation, the sound absorbing material has an arched cross section, and the sound attenuation canopy includes a support member formed of a relatively rigid material fit over an outer surface of the sound absorbing material, e.g., to provide protection and conformance of the desired shape.

According to another implementation, the sound attenuation canopy includes at least one exterior sound absorbing member spaced apart from and facing the first opening. A sound transmission path extending between the opening and the side opening can comprise at least one change of direction greater than 45 degrees, and at least one additional change of direction downstream from the side opening.

According to some implementations, the Sound Transmission Class for sound passing through the opening and the side opening is increased by at least 7 as compared to sound passing through the opening without the sound attenuation canopy.

According to some implementations that include at least one supplemental sound absorbing member positioned in a plane of the opening, the Sound Transmission Class for sound passing through the opening and the side opening is increased by at least 15 as compared to sound passing through the opening without the sound attenuation canopy and at least one supplemental sound absorbing member.

In the case of a first sound attenuation canopy and a second sound attenuation canopy, the second sound attenuation canopy can be positioned relative to the first sound attenuation canopy such that the second canopy's axis is approximately perpendicular to the first canopy's axis to increase the distance between the respective side openings and further decrease direct sound transmission between the two respective ceiling openings.

According to some implementations, the sound absorbing member is configured to collapse at a predetermined temperature, descending to at least partially cover the opening and reduce the area of opening that is open to airflow, and thereby reducing the ability of smoke to travel through the opening in the event of a fire within the occupied space.

According to a method implementation, a method of reducing sound transmission levels in a building comprising multiple rooms separated by walls, at least some of the rooms having respective ceiling openings in airflow communication with a common plenum space, includes providing a sound absorbing member made of a flexible material in a length longer than a ceiling opening for a first room, positioning a first end of the sound absorbing member at a first end of the ceiling opening, forming the sound absorbing member into an arch shape and positioning a second end of the sound absorbing member at a second end of the ceiling opening, the sound absorbing member at least partially defining, together with the ceiling opening, a pair of side openings, and causing sound waves to change in direction as the sound waves travel between the first room, through the ceiling opening, encountering the sound absorbing member, and through the side openings and into the plenum space.

The methods may include dimensioning the side openings to have an area not less than a smallest airflow area in an overall air handling system that includes the first room. The methods may include positioning supplemental sound absorbing members in approximately the plane of the ceiling opening.

When the opening is fitted with a return air grille, the methods may include placing the supplemental sound absorbing members on a perforated cover member of the return air grille such that the supplemental sound absorbing members cover at least some perforations. The methods may include positioning exterior sound absorbing members spaced apart from and facing the side openings, wherein the sound waves traveling through the side openings are caused to change direction by the exterior sound absorbing members.

The foregoing and other features and advantages will become more apparent from the following detailed description, which proceeds with reference to the accompanying figures.

DETAILED DESCRIPTION

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and subcombinations with one another. The methods, apparatus, and systems are not limited to any specific aspect or feature or combination thereof, nor do the disclosed embodiments require that any one or more specific advantages be present or problems be solved.

The use of the terms "a" and "an" and "the" and similar referents in the context of describing the embodiments (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of protection unless otherwise claimed. No language in the specification should be construed as indicating any non-claimed element as essential to the practice of the invention.

Figure 1:
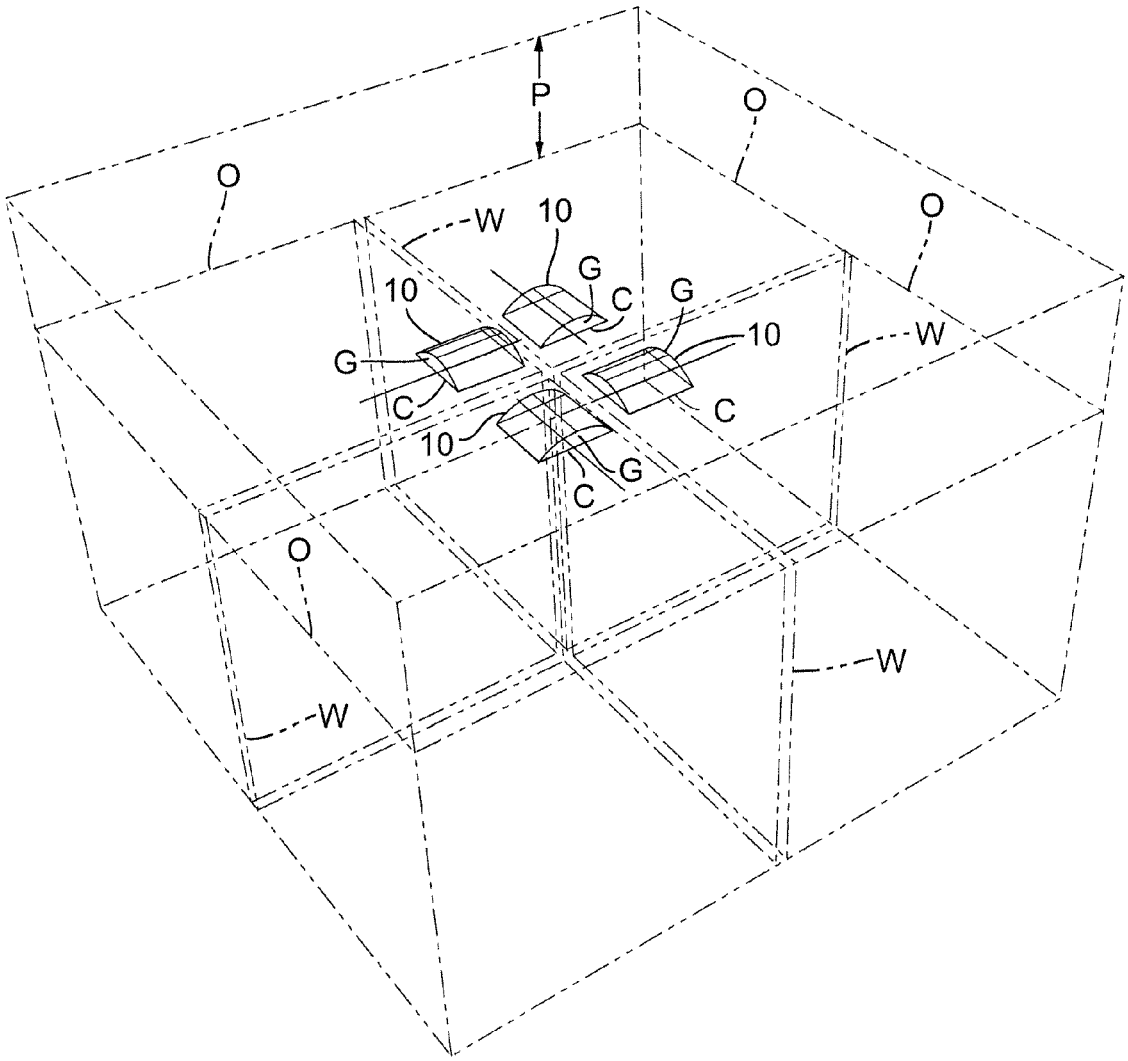
FIG. 1 is a perspective view of four adjoining offices, each office having a ceiling opening fitted with a return air grille and connecting the office to a common plenum cavity, and each opening also being fitted with a sound attenuation canopy.

FIG. 1 shows a portion of a building with four adjoining rooms, such as four offices O in an office space environment. Each of the offices O as illustrated in FIG. 1 shares two of its walls W with two of the other offices. Each office O has a ceiling opening C fitted with a conventional return air grille G that connects each office with a common plenum space P for air handling purposes located above the ceiling. For clarity, the ceiling and the surface that forms the upper extent of and encloses the plenum space P, which is typically the lower surface of the next floor, has been shown as transparent surfaces in FIG. 1.

The foot print of a typical office has become smaller, and the plenum space above such an office is increasingly crowded with equipment and other obstructions, so the ceiling openings C for adjacent offices are often spaced very close to each other. The spacing of the ceiling openings C for the four offices as shown in FIG. 1 represents close to a worst case condition because of the minimal distance separating the ceiling openings from each other (more advantageously, each opening would be located above the approximate center of the respective office). Although the adjoining offices O are separated from each other by walls, and efforts are made to prevent sound from travelling through the walls, sound from any one of the offices can travel into the ceiling plenum space P through the ceiling opening C for that office, and then from the ceiling plenum space P through the nearby openings C and into each of the other offices. If not addressed, such conditions can lead to unacceptably loud working conditions.

Figure 2:
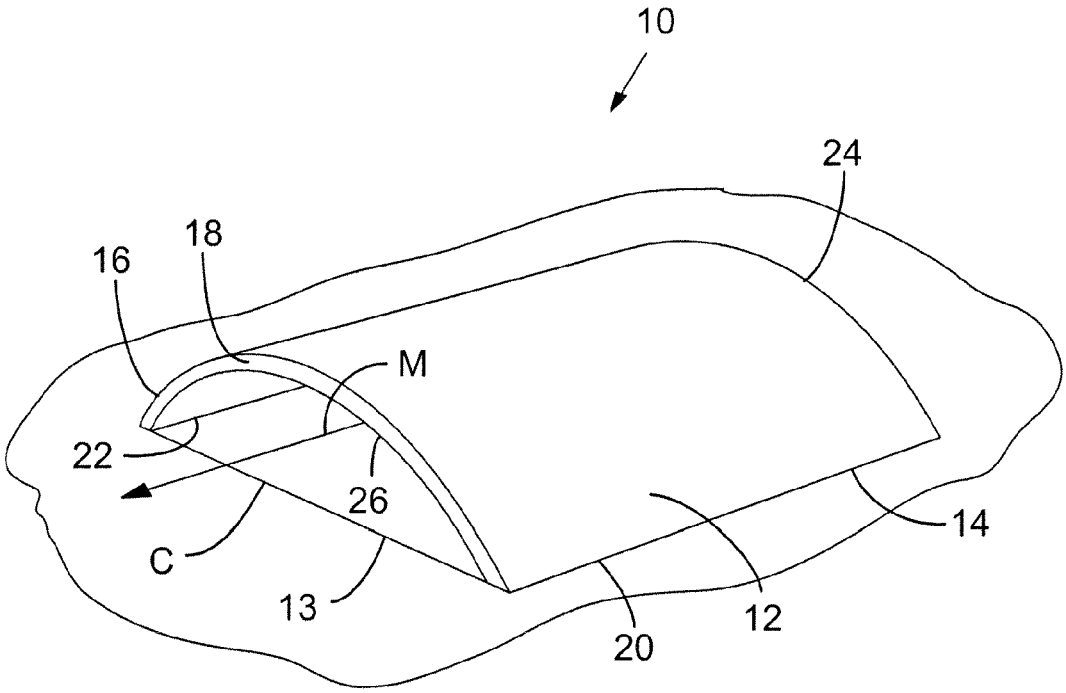
FIG. 2 is a magnified perspective view showing one sound attenuation canopy mounted in relation to a ceiling opening.

In FIG. 1, each ceiling opening C and the return air grille G for that opening is fitted with a new sound attenuation canopy 10, also referred to herein as a SAC, to reduce the level of noise or sound that travels between adjacent offices through the ceiling plenum space P. As shown in FIG. 2, the sound attenuation canopy 10 has a sound absorbing member 12 formed of a sound absorbing material arranged above and around the ceiling opening O. Specifically, the sound absorbing member 12 is arranged to block a direct path for sound travel over at least a portion of the periphery of the ceiling opening C, and also to define at least one side opening 13. The opening(s) 13 defined by the SAC 10 are preferably sized sufficiently large so as to not restrict the air flow or other performance parameters of the HVAC system. In the illustrated embodiment, the sound absorbing member 10 has a first end 14 attached to block one portion of the periphery, a second end 16 attached to block a second portion of the periphery, and an intermediate portion 18 arranged above the opening O and to define at least one side opening 13 (as illustrated in FIG. 2, two such side openings 13 are defined, one of which is visible). In the illustrated embodiment, the sound absorbing member 12 curves smoothly and the SAC 10 is generally arch-shaped in elevation.

Although ceiling openings may have other shapes, most are rectangular, such as the square opening C. For a rectangular ceiling opening, the SAC 10 conveniently has a rectangular footprint of dimensions that compliment those of the ceiling opening area. In the embodiment illustrated in FIG. 2, the sound absorbing member 12 has a first pair of opposing sides 20, 22, and a second pair of opposing sides 24, 26.

As can be seen in FIG. 2, with the SAC 10 in place, the sound transmission path M through open space taken by sound emanating from the ceiling opening O and exiting through the opening 13 is forced through a substantial change in direction compared to the straight path through a ceiling opening without a SAC. The change in direction may be greater than 45 degrees, or, as shown in FIG. 2, even about 90 degrees. By forcing at least some of the sound waves through a substantial change in direction, the sound waves lose energy, so the resulting sound level is lessened or attenuated.

Referring again to FIG. 1, it is noted that the four SAC's 10 are positioned such that the side openings of different SAC's are not positioned directly opposite from each other. Where possible, the side opening of each SAC is opposite a wall of an adjacent SAC.

Figure 3:
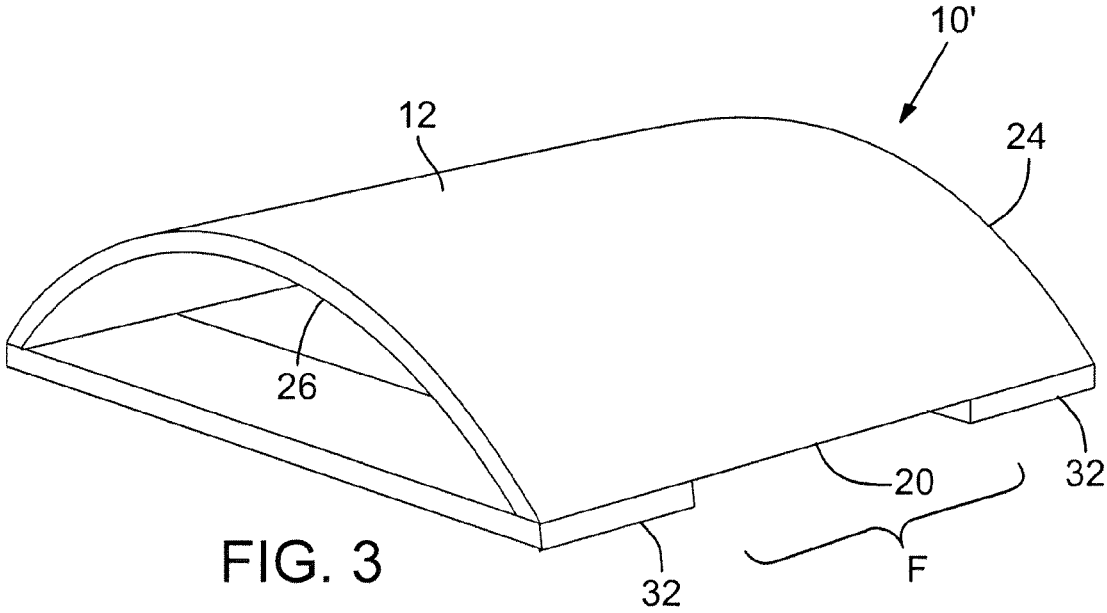
FIG. 3 is a perspective view of an implementation of a sound attenuation canopy having a generally arched shape in elevation and shown together with two supplemental sound absorbing members.
Figure 4:
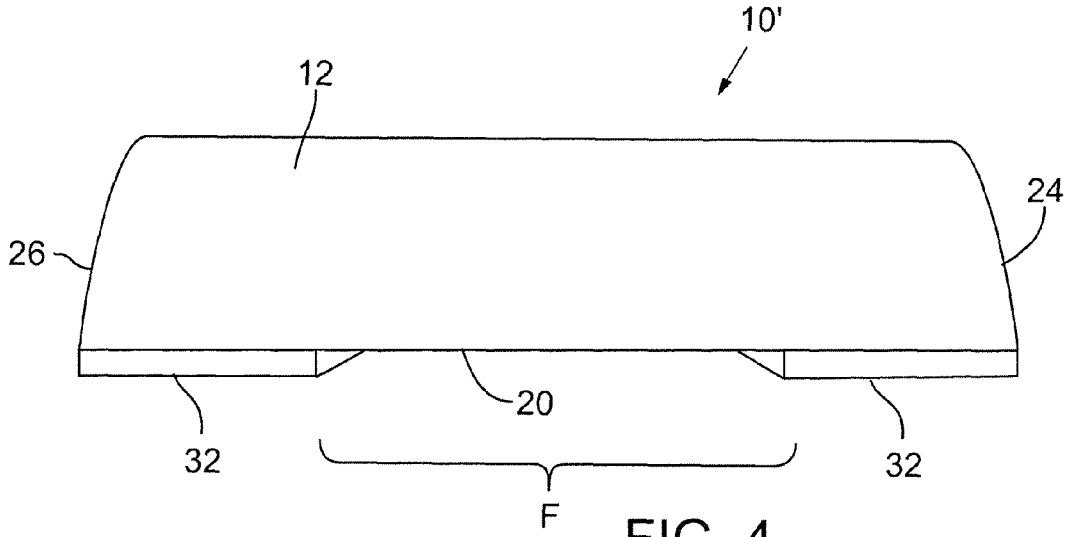
FIG. 4 is a right side view of the sound attenuation canopy of FIG. 3.
Figure 5:
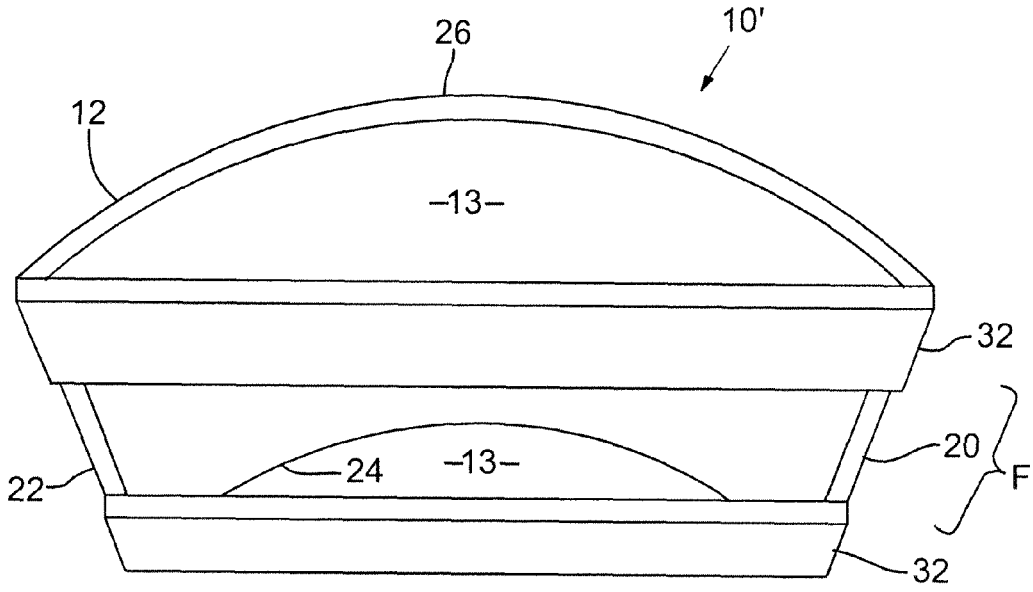
FIG. 5 is a front side and bottom side perspective view of the sound attenuation canopy of FIG. 3.
Figure 6:
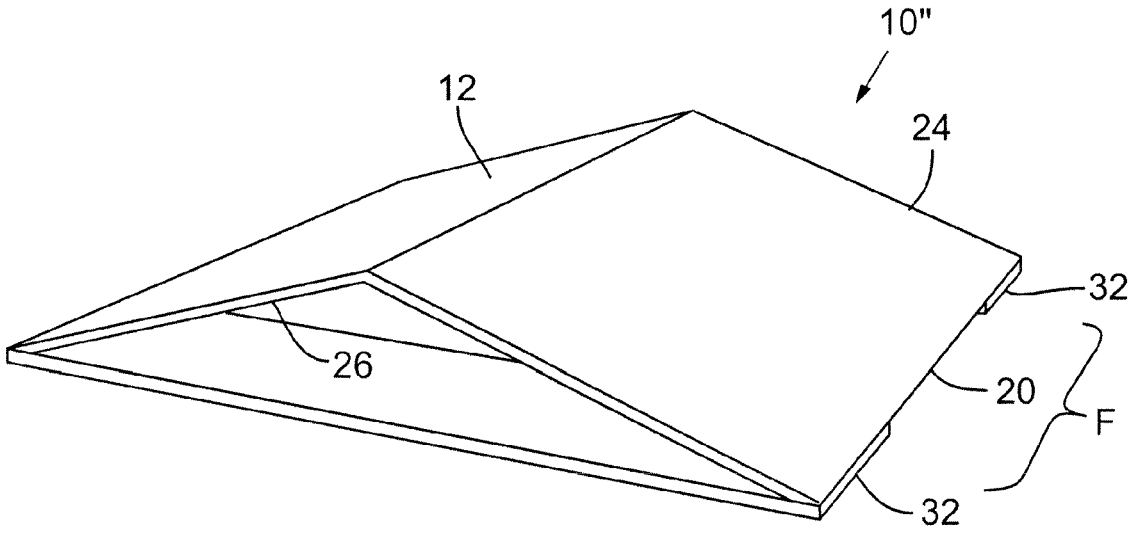
FIG. 6 is a perspective view of an implementation of a sound attenuation canopy having a generally peaked shape in elevation and shown together with two supplemental sound absorbing members.
Figure 7:
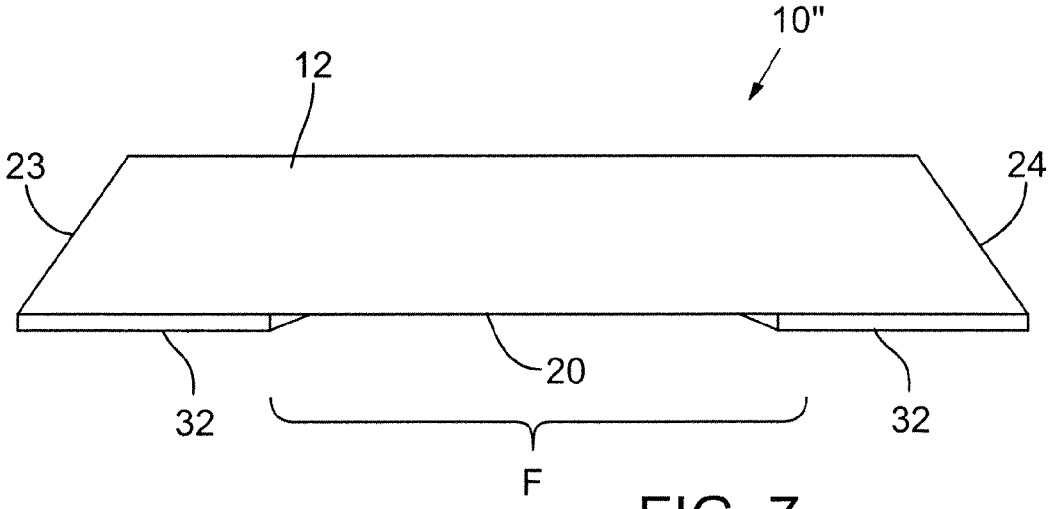
FIG. 7 is a right side view of the sound attenuation canopy of FIG. 6.
Figure 8:
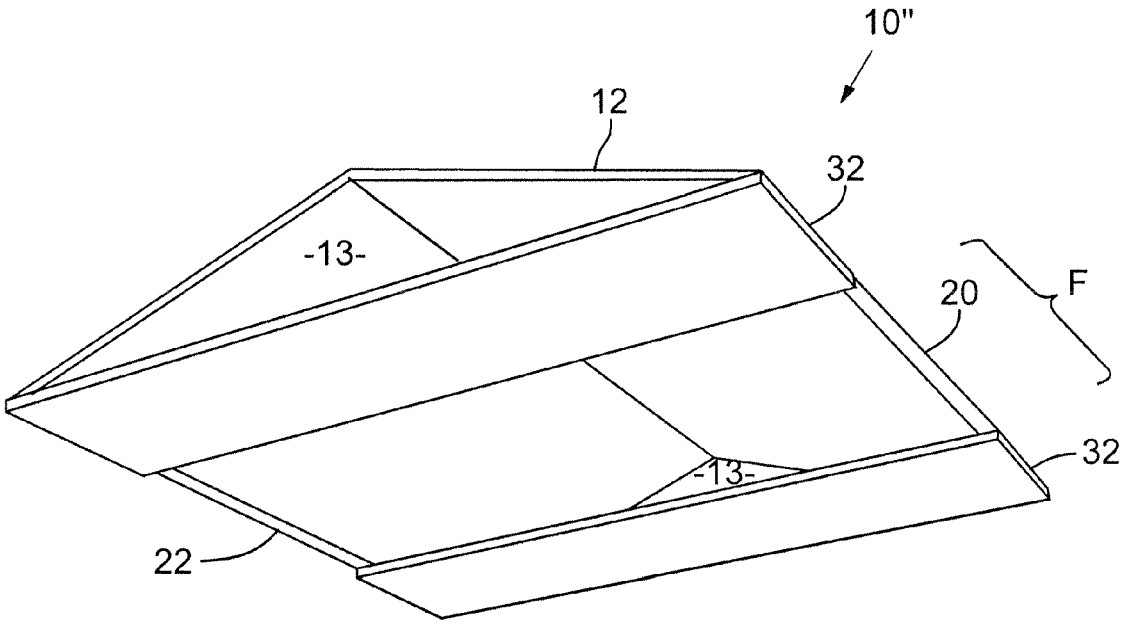
FIG. 8 is a front side and bottom side perspective view of the sound attenuation canopy of FIG. 6.

FIGS. 3, 4 and 5 show a SAC 10' having a generally arched shape in elevation, and FIGS. 6, 7 and 8 show a SAC 10" having a generally peaked shape in elevation. In both embodiments, the SAC 10', 10" includes one or more supplemental sound absorbing members, such as the pair of sound absorbing members 32 as shown in FIGS. 3-8. In the illustrated implementations, the supplemental sound absorbing members 32 are arranged approximately at or generally parallel to the plane of the ceiling opening and extending to each side opening. The members 32 effectively reduce the size of the free area F, i.e., the area directly above the ceiling opening that is open to air flow (usually through a perforated cover member). Restricting the free area F would normally reduce the performance of the HVAC system because airflow would be reduced. In some implementations, however, there may be an open area at an upstream point in the system with an area smaller than the ceiling opening. If so, it is possible to restrict the free area F, thereby resulting in greater sound reduction, without decreasing the airflow through the opening.

Figure 12:
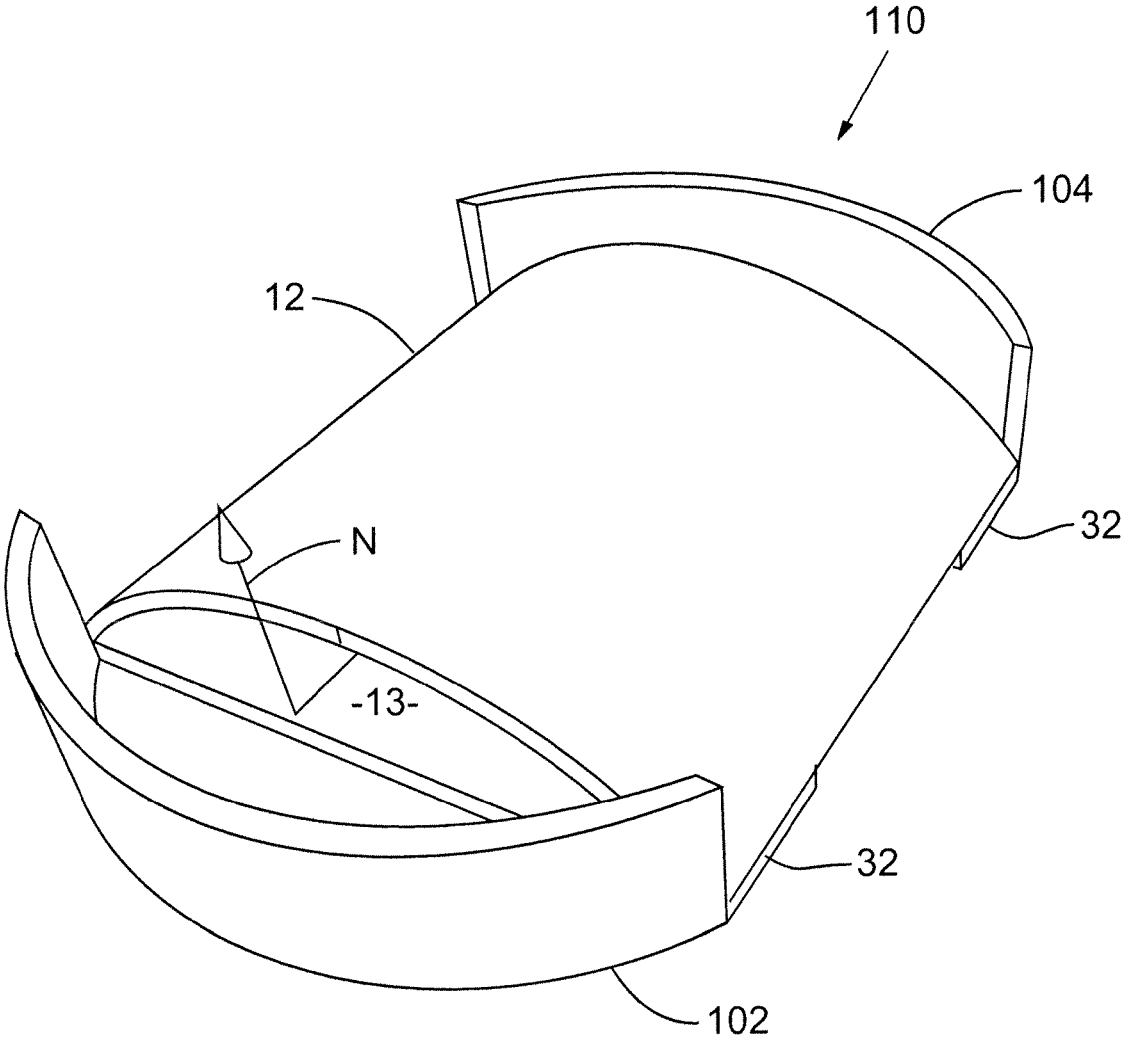
FIG. 12 is a perspective view of another implementation of the sound attenuation canopy having a generally arched shape in elevation and two supplemental sound absorbing members, together with two exterior curved members.

FIG. 12 shows an alternative SAC 100 which is substantially the same as the SAC 10' shown in FIGS. 3-5, except a pair exterior sound absorption members 102, 104 have been positioned spaced apart from and facing each of the side openings 13. The exterior sound absorption members serve to absorb more of the sound and direct it vertically upward through openings defined between the member 12 and the inner surfaces of the members 102, 104, respectively. These openings are preferably at least as large as the side openings 13 so as not adversely affect airflow. The arrow N illustrates that the sound transmission path has two "bends" or changes in direction: the first being similar to the bend in the path M taken by sound emanating from the ceiling opening O and exiting through the opening 13, which is not shown in FIG. 12 but is as shown in FIG. 2, and the second being the bend as the sound is directed vertically upward thorough the opening by the inner surface of the member 102 as shown in FIG. 12. Thus, there may be two changes in direction, and they may be greater than 45 degrees, or, as shown in FIG. 12, even about 90 degrees.

Figure 9:
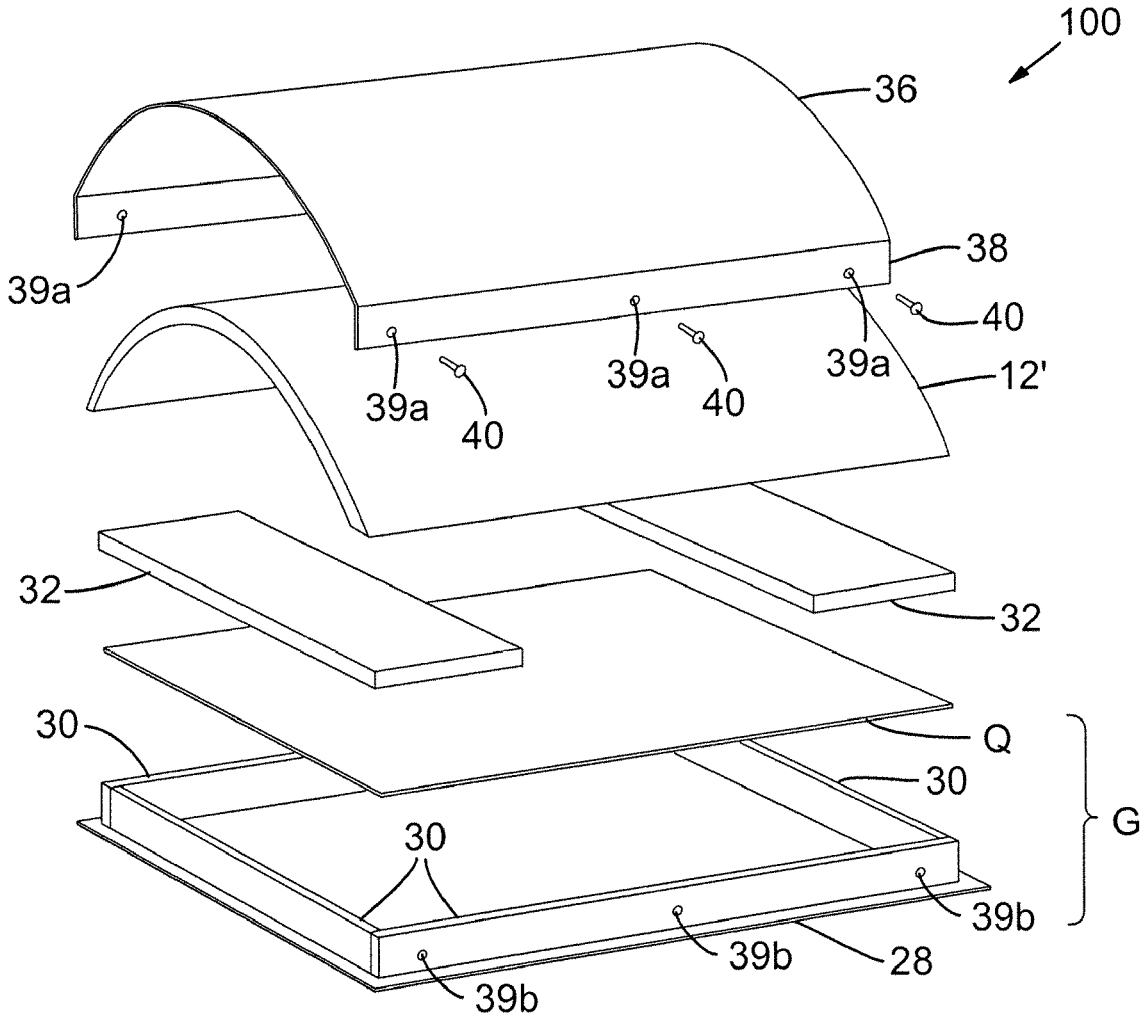
FIG. 9 is an exploded view of a sound attenuation canopy shown in relation to components of a return air grille to which it is attached.

FIG. 9 is an exploded view of a SAC 100 shown in relation to a typical grille assembly G fitted in the ceiling opening O. The grille assembly G has frame 28 which typically is sized for the ceiling opening and may be held in place by gravity or attached to the ceiling at various points around its periphery. The frame 28 may have flanges 30 as shown, and the flanges 30 may project through the ceiling opening when the frame 28 is installed. One typical grille assembly has a perforated cover member Q that serves as the air handling device and is arranged in the frame. The SAC 100 includes an arch-shaped sound absorbing member 12' arranged above a perforated cover member Q and two supplemental sound absorbing members 32 that are set on an upper side of the perforated cover member Q. The supplemental sound absorbing members 32 are laid on an upper side of the perforated cover member Q.

Figure 10:
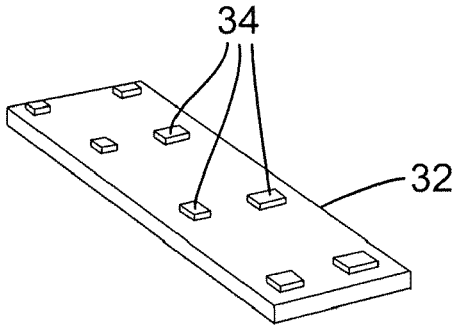
FIG. 10 is a perspective view of a supplemental sound absorption member with spacers.

If desired, the supplemental sound absorbing members 32 can be spaced apart from the perforated cover member. Referring to FIG. 10, one of the supplemental sound absorbing members 32 is shown with spacer members 34 that are sized to result in an appropriate gap between the body of the supplemental sound absorbing member and the perforated cover member Q.

Referring again to FIG. 9, the SAC 100 can include an optional support member 36 shaped to fit over and follow the contour of the sound absorbing member 12'. The support member 36 is preferably formed of a material that is less resilient than the sound absorbing member 12' so that the member 36 can support and give shape to the member 12'. For example, the support member 36 can be formed of steel, such as 30 gauge metal plate. The support member 36 can be configured to have flanges 38 for mounting the support member 36, such as to the flanges 30 of the frame 28. In this example, apertures 39*a* in the support member 36 are aligned with apertures 39*b* in the flanges 30 and secured with suitable fasteners 40, such as rivets.

One suitable grille assembly G and perforated cover Q is the Titus PDR ("perforated diffuser" for "return" air flow) model available from Titus.

By way of background, Sound Transmission Class is one recognized measure of the sound that passes through a solid/composite material. The Sound Transmission Class (STC) number is derived from sound attenuation values tested at sixteen standard frequencies from 125 Hz to 4000 Hz. It is noted that normal human speech is said to have a range of about 300 to about 3500 Hz. The transmission-loss values are then plotted on a sound pressure level graph and the resulting curve is compared to a standard reference contour. To determine the STC value, standard reference contours are moved up or down (i.e., y-coordinate shifts are used) until a best fit is achieved. Comparison of STC levels is appropriate for assemblies having more than one material through which sound is transmitted.

Table 1 depicts a range of representative STC levels and corresponding qualitative descriptions of what can be heard at the indicated sound transmission level.

TABLE 1

| STC | What Can Be Heard |
|---|---|
| 25 | Normal speech can be understood easily and distinctly through wall |
| 30 | Loud speech can be understood fairly well, normal speech can be heard but not understood |
| 35 | Loud speech is audible but not intelligible |
| 40 | Onset of "privacy" |
| 42 | Loud speech audible as murmur |
| 45 | Loud speech is not audible; 90% of statistical population is not annoyed |
| 50 | Very loud sounds such as musical instruments or a stereo can be faintly heard; 99% of statistical population is not annoyed |
| 60+ | Superior soundproofing; most sounds are inaudible |

Table 2 depicts a range of STC levels for different types of conventional walls and partitions.

TABLE 2

| STC | Partition Type |
|---|---|
| 33 | Single layer of ½" drywall on each side, wood studs, no insulation (typical interior wall) |
| 45 | Double layer of ½" drywall on each side, wood studs, batt insulation in wall |
| 46 | Single layer of ½" drywall, glued to 6" lightweight concrete block wall, painted both sides |
| 54 | Single layer of ½" drywall, glued to 8" dense concrete block wall, painted both sides |
| 55 | Double layer of ½" drywall on each side, on staggered wood stud wall, batt insulation in wall |
| 59 | Double layer of ½" drywall on each side, on wood stud wall, resilient channels on one side, batt insulation in wall |
| 63 | Double layer of ½" drywall on each side, on double wood/metal stud walls (spaced 1" apart), double batt insulation |
| 72 | 8" dense concrete wall, painted, with ½" drywall on independent steel stud walls, each side, insulation in cavities |

The sound absorbing material 12 can be any suitable sound absorbing material that delivers satisfactory sound attenuating performance, as well as meets one or more other criteria, which may include cost, ease of safe handling, ease of forming, fire resistance, etc.

One material found to deliver satisfactory sound attenuating performance and to meet other criteria is Echo Eliminator™ Plenum Barrier (EEPB) material available from Acoustical Surfaces, Inc. The EEPB material comprises substantially recycled cotton fibers and is treated for fire resistance (EEPB is advertised as a Class A nonflammable material). The EEPB material reportedly does not contain any fiberglass, formaldehyde or VOCs. The EEPB material may be faced with another material, such as a foil, for easy handling. Among the many other suitable materials for the sound absorbing material 12 is Quiet Barrier® acoustic foam available from American Micro Industries, Inc.

Figure 11:
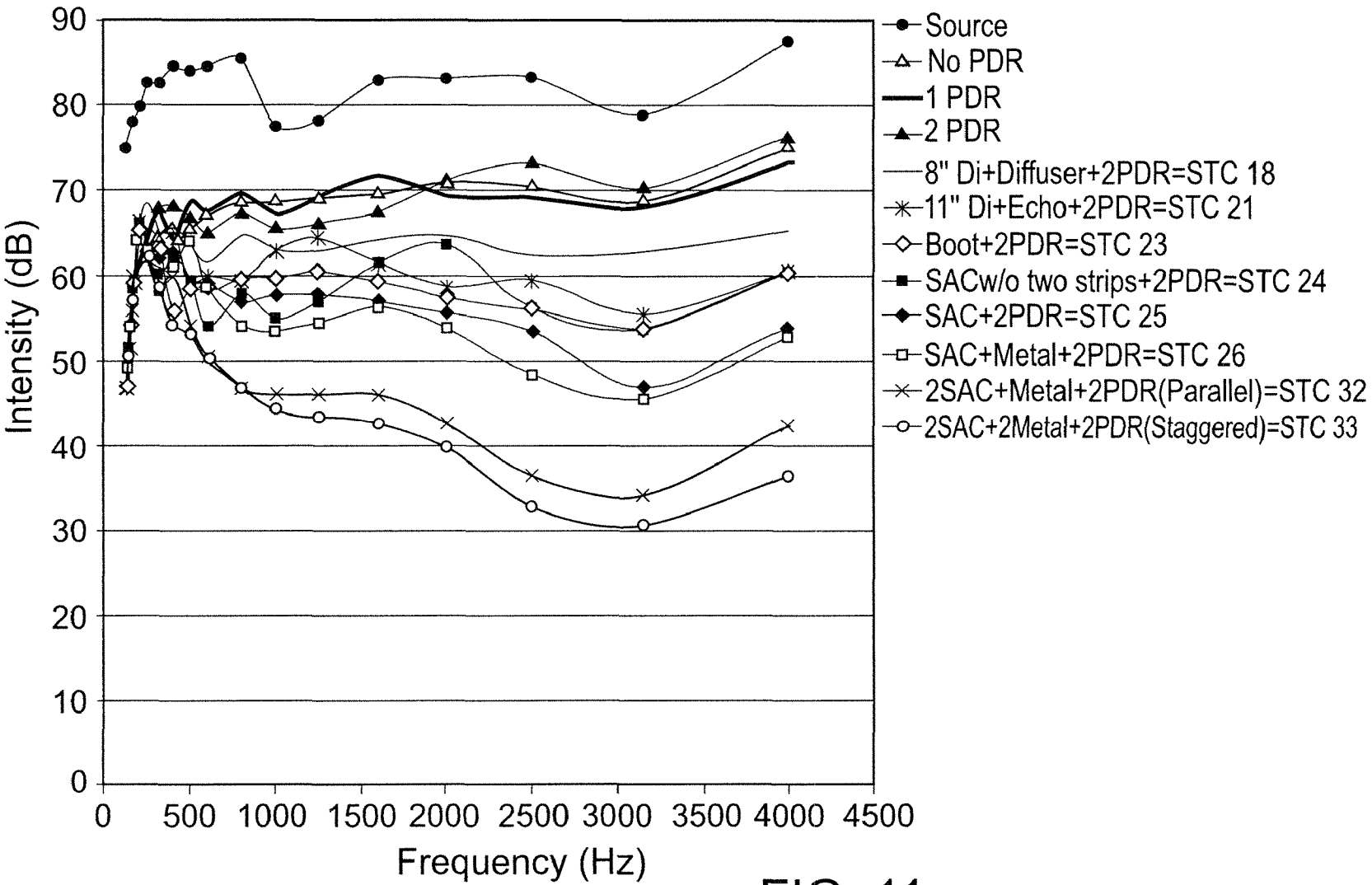
FIG. 11 is a graph showing sound frequency vs. sound intensity under an array of different test conditions.

FIG. 11 is a graph of sound frequency vs. sound intensity to measure representative sound transmission from a first room through a first ceiling opening to a second ceiling opening and into a second room. One or both of the openings were configured differently in each of the tests to develop a measure of performance for the different configurations. The uppermost curve, labeled "Source," has the greatest intensity and shows the baseline for the audio source used. The source, which was pink noise, was positioned about 5" below the ceiling opening in the first room. The receiver or microphone was positioned 5" in front of the speakers.

The next curve, labeled "No PDR," shows the sound transmission measured in the second room (or "sound sampling location") when the audio source is transmitting the baseline signal from the first room (or "source location") where both the first ceiling opening and the second ceiling opening are substantially free from obstruction, i.e., the perforated cover member Q has been removed. This configuration had a measured STC of 10. The receiver, which was a microphone, was positioned about 1" below the ceiling opening in the second room. The difference between the Source and No PDR curves, i.e., STC=10, is the degree to which sound is absorbed by the plenum cavity and other structure between the first opening and the second opening.

The curve labeled "1 PDR" shows the sound transmission measured when the second ceiling opening is fitted with a conventional Titus PDR (return air diffuser), i.e., the cover member Q, and the first opening is substantially free from obstruction. The curve labeled "2 PDR" shows the sound transmission measured when the first ceiling opening and the second ceiling opening are each fitted with a PDR.

The curve labeled "8" Di+Diffuser+2 PDR" indicates that the second opening was fitted with a PDR and a conventional 8" supply duct and diffuser, and the first opening was fitted with a PDR. Thus, this testing evaluated whether fitting the second opening with a conventional diffuser having an open area equal to an 8" supply duct would be effective in reducing sound transmission. This configuration had a measured STC of 18.

The curve labeled "11" Di+Diffuser+2 PDR" indicates that the second opening was fitted with a PDR and a conventional 11" supply duct and diffuser, and the first opening was fitted with a PDR. Thus, this testing evaluated whether fitting the second opening with a conventional diffuser having an open area equal to an 11" supply duct would be effective in reducing sound transmission. This configuration had a measured STC of 21.

The curve labeled "Boot+2 PDR" indicates that the second opening was fitted with a PDR and a conventional boot (i.e., enclosed duct), and the first opening was fitted with a PDR. This configuration had a measured STC of 23.

The curve labeled "SAC w/o two strips+2 PDR" indicates that the second opening was fitted with a PDR and a SAC according to FIG. 2, and the first opening was fitted with a PDR. This configuration had a measured STC of 24.

The curve labeled "SAC+2 PDR" indicates that the second opening was fitted with a PDR and a SAC having two supplemental sound absorbing members 32 (or "strips") according to FIG. 3, and the first opening was fitted with a PDR. This configuration had a measured STC of 25.

The curve labeled "SAC+Metal+2 PDR" indicates that the second opening was fitted with a PDR, a SAC having two sound absorbing members 32, and a metal support member 36 over the SAC as shown in FIG. 9. The first opening was fitted with a PDR. This configuration had a measured STC of 26.

The curve labeled "2 SAC+2 Metal+2 PDR (Parallel)" indicates that the second opening and the first opening were each fitted with a PDR, a SAC having two sound absorbing members 32, and a metal support member 36 over the STC. The axes of the two SAC's were parallel to each other, such that the respective side openings 13 were directly facing each other. This configuration had a measured STC of 32.

The curve labeled "2 SAC+2 Metal+2 PDR (Staggered)" indicates that the second opening and the first opening were each fitted with a PDR, a SAC having two sound absorbing members 32, and a metal support member 36 over the SAC. The two SAC's were staggered relative to each other, i.e., their respective axes were approximately perpendicular to each other as in FIG. 1, and their respective side openings 13 were not directly facing each other. This configuration had a measured STC of 33.

The test results as depicted in FIG. 11 show that the SAC provides a significant reduction in sound transmission, as is reflected by the increasing STC values for implementations employing the SAC. As can be seen, the STC can be increased from about 10 to about 33 by installing two SAC's that have a staggered orientation with other, the SAC's also having the metal support member 36 and the two supplemental sound absorbing members 32.

In addition, it can be seen that the STC can be increased by at least 10 between two openings each having a PDR by adding one SAC, without supplemental sound absorption members, to one of the openings. Adding the supplemental sound absorption members 32 having an area of about 50% of the ceiling opening area to the single SAC increases the STC for the configuration to at least 14. Further, adding the metal support member 36 to this configuration increases the STC to at least 15.

The testing that led to the results shown in FIG. 11 took place in a worst case condition with the first opening and the second opening being spaced apart at their nearest edges by only about 4.5 inches. Therefore, it would expected that the lowest STC value of 10 would be higher in actual conditions encountered in the field where the first and second openings are typically separated by a greater distance, as sound intensity changes according to the square of the distance separating the source and the receiver.

Turning to some general observations, testing revealed that the STC improves by about 2 if the thickness of the EEPB material is doubled from about 1" nominal to about 2" nominal. As the height of SAC is decreased, thus decreasing the area of the side opening 13, the STC level also increases.

In the testing of FIG. 11, the Titus PDR ceiling diffuser has an area of 24"×24". For the SAC sound absorbing member 12, EEPB material having a thickness of 1" was cut to dimensions of 24×26". The metal support member 36 was formed of 30 gage galvanized sheet metal and cut to dimensions of 24×28". The metal support member 36 was attached the frame 30 of the PDR with ten 5/16" rivets. The sound absorbing member 36 was fit with each of its short sides or ends contacting the frame, and its foil side facing out and curving along the contoured support member 36. Where specified, the two supplemental sound absorbing members 32 were formed in 6×23" strips of the 1" EEPB material, i.e., sized to lie flat in approximately the plane of the opening. Conventional ceramic tiles with dimensions of about 0.75×0.75×0.40" were adhered to the strips using Silicone 3 adhesive to serve as the spacers 34. The tiles are inexpensive serve and readily available (the tiles are available from Home Depot or other equivalent home improvement stores). After the perforated cover member Q is installed, the strips were placed on top of the cover member Q (see FIGS. 9 and 10), with the spacers 34 providing a gap between the cover member Q and the strips.

The PDR has an area of about 24×24," i.e., 576 square inches. The perforated cover member Q that fits this PDR is available in several different perforation densities, and one common perforation density is 50%. For a cover member Q with a perforation density of 50% that fits the 24×24" area, the resulting cross sectional area open to air flow is thus 288 square inches.

In general, reducing this area open to airflow tends to decrease sound transmission and increase the STC. In most circumstances, however, it is desirable to maintain the area open to airflow in the vicinity of the ceiling opening at no less than the smallest upstream cross-sectional area. For example, in cases where 10" diameter ductwork is used, then the target open area in the vicinity of the ceiling opening is no less than about 78.5 square inches.

In many applications where the amount of airflow at the location of the ceiling opening is not critical, e.g., where the opening is oversized for the current airflow, it is possible to use the supplemental sound absorption members 32 by having them directly contact the cover member Q and thus potentially block a portion of its open area. In these cases, it is prudent to size the supplemental sound absorption members such that adequate air flow is maintained and the members do not exceed 50% of the return air grille area.

If the supplemental sound absorption members are slightly spaced from the cover member Q, such as by using the spacer members 34 or otherwise providing for a spacing of at least 0.125 inch, then the sound absorption performance is approximately the same but air flow is generally not restricted. Thus, it is generally advantageous to space the supplemental absorption members away from the perforated cover member because sound absorption performance is maintained and air flow is not restricted, but in situations where airflow is not limiting, no such spacing may be required.

The SAC is flexible compared to other elements designed to attach to or over return air grilles. As a result, the SAC is adaptable to different geometry and can be formed into a different shape as necessary, e.g., to avoid obstructions in the space above the ceiling opening, especially in retrofit situations. The SAC can be used without any support or reinforcement members, such as without the member 36, if necessary. Conventional attenuators formed of rigid materials are not capable of being easily adapted to different geometries.

The SAC provides additional advantages over conventional approaches. For example, the SAC reduces the amount of debris and/or dust from the plenum cavity that falls into the room and/or on a worker when the return air grille, an adjacent ceiling tile or a light fixture is accessed, such as for service. In addition, the SAC is relatively lightweight and easy to install.

The SAC can provide some safety benefits in the event of smoke or fire. The SAC may prevent burning debris from falling onto the air flow grille and/or into the room. The SAC may restrict the amount of smoke that would normally enter the room through the ceiling opening.

In addition, the SAC can be designed to cover the ceiling opening, or to at least reduce the size of the side openings, in the case of a fire or other event. For example, the SAC can be designed to collapse and cover the ceiling opening and air flow grille, substantially restricting air flow through the ceiling opening. The SAC material can be designed to change in form, such as by shrinking or expanding, in response to a condition, such as temperature or voltage potential. In some embodiments, the SAC member can be designed in multiple pieces connected by elements that respond to a particular temperature and/or voltage potential, thus allowing the SAC member to separate and collapse under predetermined conditions.

Although the SAC has been described in connection with a ceiling opening, such as a ceiling opening conventionally fitted with a return air grille, the SAC could be used in other situations where sound transmission needs to be mitigated. For example, the SAC can be used with other types of openings, such as openings for supply air. In addition, the SAC is not limited to ceiling openings, but it can be used for wall openings, floor openings and openings at still other locations.

In view of the many possible embodiments to which the disclosed principles may be applied, it should be recognized that the illustrated embodiments are only preferred examples and should not be taken as limiting in scope. Rather, the scope of protection is defined by the following claims. We therefore claim all that comes within the scope and spirit of these claims.

We claim:

1. A method of reducing sound transmission levels in a building comprising multiple rooms separated by walls, at least some of the rooms having respective ceiling openings in airflow communication with a common plenum space, the method comprising:

providing a substantially planar sound absorbing member made of a flexible material in a length longer than a ceiling opening for a first room;

positioning a first end of the sound absorbing member at a first end of the ceiling opening;

forming the substantially planar sound absorbing member by hand into an arch shape or a peak shape and positioning a second end of the sound absorbing member at a second end of the ceiling opening to self-supportingly retain the arch shape or the peak shape, the sound absorbing member at least partially defining, together with a perimeter of the ceiling opening, a pair of side openings; and configuring a sound transmission path to have at least one change of direction greater than 45 degrees between the ceiling opening and at least one of the pair of side openings.

2. The method of claim 1, further comprising dimensioning the side openings to have a total area not less than a smallest airflow area in an overall air handling system that includes the first room.

3. The method of claim 1, further comprising positioning supplemental sound absorbing members in approximately the plane of the ceiling opening.

4. The method of claim 3, wherein the opening is fitted with a return air grille, further comprising placing the supplemental sound absorbing members on a perforated cover member of the return air grille such that the supplemental sound absorbing members cover at least some perforations.

5. The method of claim 1, further comprising positioning exterior sound absorbing members spaced apart from and facing the side openings, wherein the sound waves traveling through the side openings are caused to change direction by the exterior sound absorbing members.

6. The method of claim 1, wherein forming the sound absorbing member into an arch shape or a peak shape comprises configuring the sound absorbing member to have an apex more distant from the ceiling opening than points on either side of the apex.

7. The method of claim 1, wherein configuring the sound transmission path to have at least one change of direction comprises increasing the sound transmission class by at least 10 for sound passing through the ceiling opening and the pair of side openings.

8. The method of claim 1, wherein configuring the sound transmission path to have at least one change of direction comprises positioning at least one supplemental sound absorbing member to cover no more than 50% of the ceiling opening and increasing the sound transmission class by at least 14for sound passing through the ceiling opening and the pair of side openings.

9. The method of claim 1, wherein the sound absorbing member is a first sound absorbing member, further comprising positioning a second sound absorbing member relative to a second ceiling opening such that an axis passing through side openings defined by the second sound absorbing member is approximately perpendicular to an axis passing through the side openings defined by the first sound absorbing member.

10. The method of claim 9, wherein forming the sound absorbing member into an arch shape or a peak shape comprises configuring the sound absorbing member to have an apex more distant from the ceiling opening than points on either side of the apex.

11. The method of claim 10, wherein the opening is fitted with a return air grille, further comprising placing the supplemental sound absorbing members on a perforated cover member of the return air grille such that the supplemental sound absorbing members cover at least some perforations.

12. The method of claim 9, wherein the opening is fitted with a return air grille, further comprising placing the supplemental sound absorbing members on a perforated cover member of the return air grille such that the supplemental sound absorbing members cover at least some perforations.

13. The method of claim 1, wherein the ceiling opening is rectangular, and wherein the sound absorbing member is shaped as a rectangle.

14. The method of claim 1, wherein the ceiling opening comprises a ceiling air grille, and wherein the sound absorbing member is positioned in a plenum space above the ceiling and over the ceiling opening.

15. The method of claim 1, further comprising positioning at least one supplemental sound absorbing member to overlie a portion of the opening.

16. The method of claim 1, further comprising fitting a support member formed in an arch shape or a peak shape over the sound absorbing member.

17. The method of claim 1, further comprising orienting the sound absorbing member such that the side openings defined by the sound absorbing member do not face side openings of an adjacent second sound absorbing member positioned over a second ceiling opening.

18. The method of claim 17, wherein forming the sound absorbing member into an arch shape or a peak shape comprises configuring the sound absorbing member to have an apex more distant from the ceiling opening than points on either side of the apex.

19. The method of claim 18, wherein the opening is fitted with a return air grille, further comprising placing the supplemental sound absorbing members on a perforated cover member of the return air grille such that the supplemental sound absorbing members cover at least some perforations.

20. The method of claim 1, wherein the change of direction in the sound transmission path is approximately 90°.

* * * * *